United States Patent [19]

Grise et al.

[11] Patent Number: 5,038,018

[45] Date of Patent: Aug. 6, 1991

[54] ELECTRICAL HEATING

[75] Inventors: Frederick G. J. Grise, Osterville; Paul H. Bodensiek, Centerville, both of Mass.; Lawrence Morgan, Streetsville; Demetrius Maikantis, Brampton, both of Canada; John A. Marstiller, Marstons Mills, Mass.

[73] Assignee: Flexwatt Corporation, West Wareham, Mass.

[21] Appl. No.: 411,703

[22] Filed: Sep. 25, 1989

[51] Int. Cl.[5] ..... H05B 3/34

[52] U.S. Cl. ..... 219/213; 219/549; 392/435

[58] Field of Search ..... 219/213, 345, 528, 543, 219/549, 202, 461, 462; 392/435

[56] References Cited

U.S. PATENT DOCUMENTS

| | | | |
|---|---|---|---|
| 1,174,031 | 2/1916 | Hadaway | 219/521 |
| 1,954,128 | 4/1934 | Heyroth | 219/461 |
| 2,760,726 | 8/1956 | Parks | 219/213 |
| 3,020,379 | 2/1962 | Ludlow | 219/213 |
| 3,445,628 | 5/1969 | Bateman | 219/213 |
| 3,657,516 | 4/1972 | Fujihara | 219/213 |
| 4,471,212 | 9/1984 | Hager | 219/345 |
| 4,656,339 | 4/1987 | Grise | 219/345 |

FOREIGN PATENT DOCUMENTS

| | | | |
|---|---|---|---|
| 2010466 | 10/1971 | Fed. Rep. of Germany | 219/345 |

*Primary Examiner*—Teresa J. Walberg

[57] ABSTRACT

A truck trailer or similar bulk storage area is heated by providing electrical resistance heaters in longitudinally-extending metal ducts extending from and to a short distance below the floor level. Electrical sheet resistance heaters are attached to the underside of the metal plate forming the duct top, each duct is placed between a longitudinally-extending pair of wooden floor boards, and a pair of ducts are placed side-by-side near each edge of the trailer bed or floor of the storage area.

22 Claims, 4 Drawing Sheets

ELECTRICAL HEATING

This invention relates to electrical heating and, more particularly, to systems for electrically heating cargo trailers and other storage areas and the like.

BACKGROUND OF INVENTION

U.S. Pat. Nos. 4,485,297 issued Nov. 27, 1984, 4,542,285 issued Sept. 17, 1985, 4,633,068 issued Dec. 30, 1986 and 4,774,397 issued Sept. 27, 1988, all of which are hereby incorporated by reference, disclose flexible sheet heaters including a pair of longitudinally-extending (typically copper) conductors and a semiconductor pattern extending between and electrically connected to the conductors. The heaters there disclosed provide generally superior performance and substantially even heat distribution. One principal use of such heaters has been as ceiling or floor heaters in building living space, e.g., the heaters have been stapled in place between a pair of floor joists, about 2 or 3 inches below floor level, and insulation batts have been placed in the remaining inter-beam space below the heaters.

There has been a need for a relatively inexpensive, and efficient, system for heating other types of space, such as storage areas and large truck trailers.

SUMMARY OF INVENTION

We have discovered that truck trailers and other bulk storage areas may be efficiently heated by providing electrical heaters in longitudinally-extending metal ducts extending from and to a short distance below the floor level. The relatively high thermal conductivity of the metal top of the duct insures that "hot spots" do not build up in any areas that are, for example, covered by crates, the cross-sectional area of the duct provides for conductive air flow within the duct, and the reflective metal inside surfaces of the duct also increase thermal uniformity. In preferred embodiments such as truck trailers, electrical sheet resistance heaters are attached to the underside of the metal plate forming the duct top, each duct is placed between a longitudinally-extending pair of wooden floor boards, and a pair of ducts are placed side-by-side near each edge of the trailer bed.

DESCRIPTION OF PREFERRED EMBODIMENT

Figure 1:
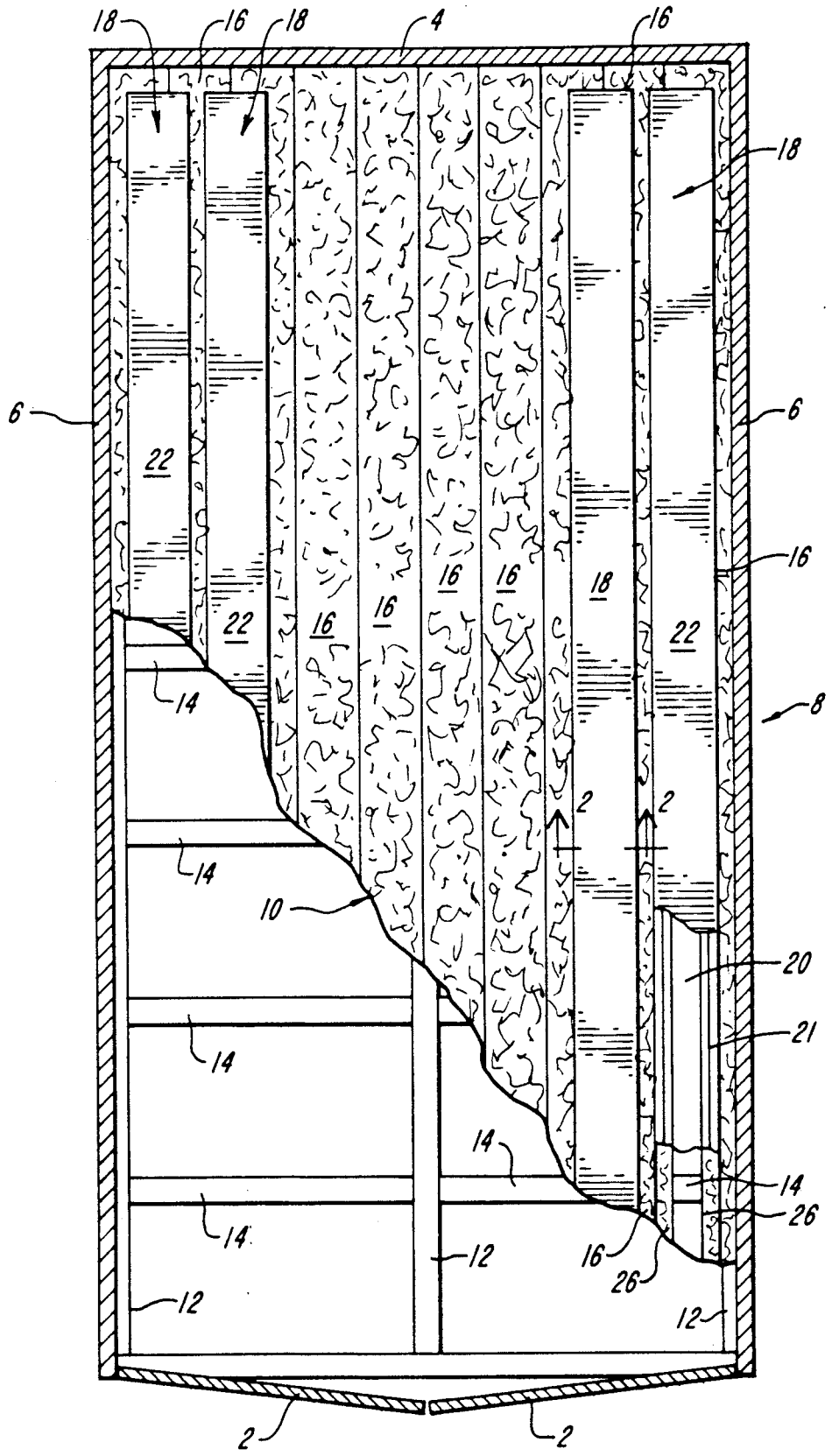
FIG. 1 is a top plan view, partially cut away, of a truck trailer including heating systems embodying the present invention.

FIG. 1 shows a truck trailer 8 that includes heating systems constructed in accord with the present invention. The basic construction of trailer 8 is conventional. The trailer bed, generally designated 10, has a support structure including longitudinally-extending support "I" beams 12 and longitudinally-spaced transverse support "I" beams 14. In a conventional trailer, longitudinally-extending wood floor boards are placed on top of and cover substantially the entire support structure. According to the present invention, much of the trailer bed 10 is covered by longitudinally-extending wood floor boards 16, but the trailer bed includes also four heating systems, generally designated 18, of the present invention.

Figure 2:
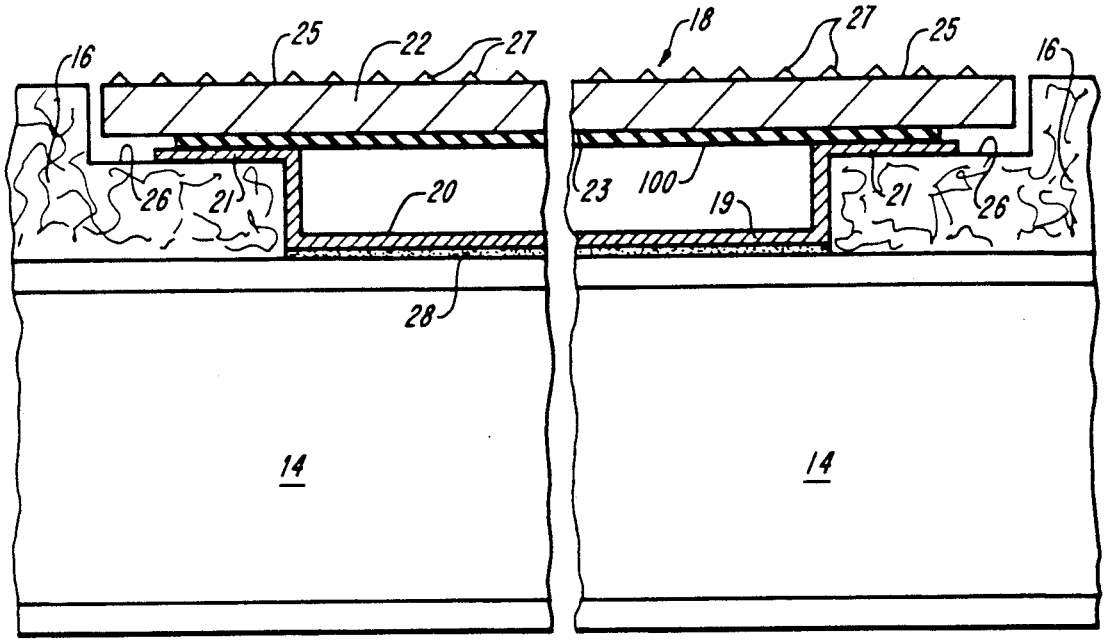
FIG. 2 is a sectional view taken at 2—2 of FIG. 1.
Figure 3:
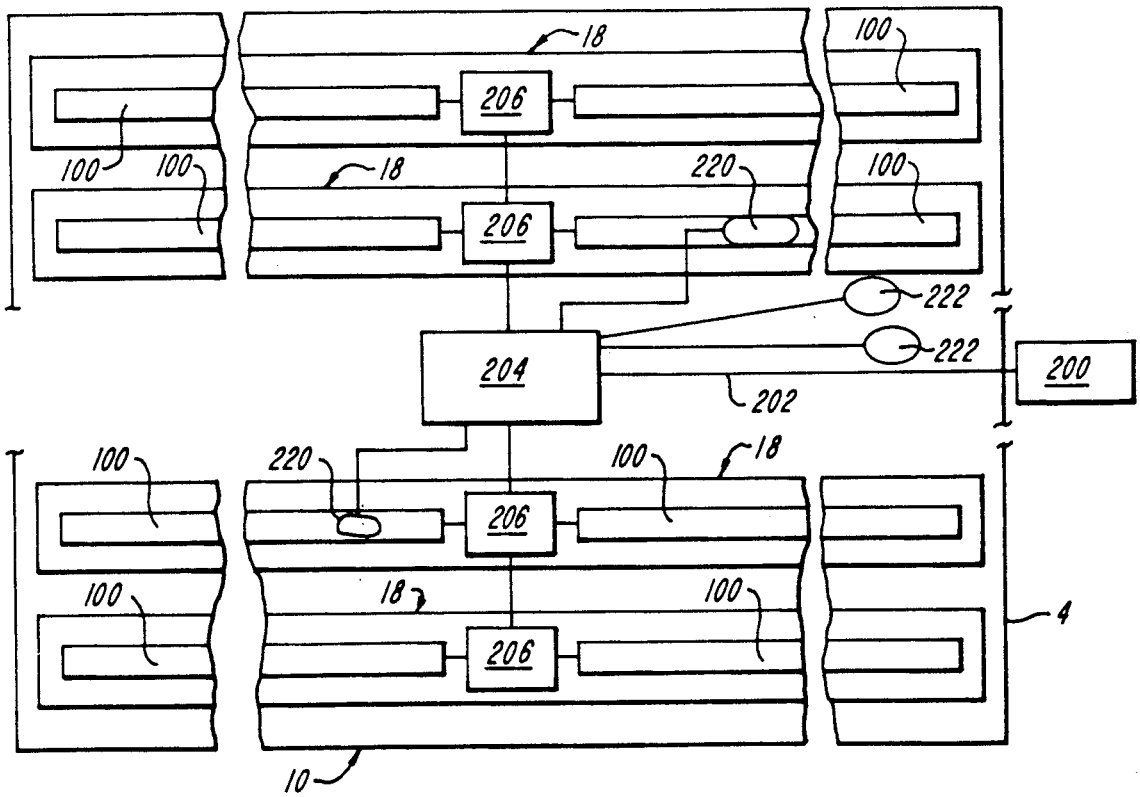
FIG. 3 is a simplified, somewhat schematic, view of the heating systems used in the trailer of FIG. 1.

Referring also to FIGS. 2 and 3, heating systems 18 extend longitudinally of trailer bed 10, parallel to each other. Two systems 18 are positioned along each side of the trailer bed 10, with one of the two closely adjacent trailer side walls 6 and the second about a foot in from the first. Each heating system 18 is slightly shorter than the overall length of the trailer bed, stopping just short of trailer front wall 4 and rear doors 2.

As shown in FIG. 2, each heating system 18 is positioned in the longitudinally-extending space between a pair of wooden floor boards 16, on top of transverse beams 14. The heating system 18 includes longitudinally-extending duct 19 comprising a polished aluminum underpan 20 and a number of aluminum cover plate 22 (each about 45 feet long), and two electrical heating elements generally designated 100 mounted in the duct.

As shown, underpan 20 is generally rectangular in transverse cross-section, about $5\frac{3}{4}$ in. wide and about 1 inch high. An about 1 inch wide outwardly projecting flange 21 extends longitudinally along and projects outwardly from each of the upper side edges of pan 20. Cover plate 22 is about 10 inches wide and $\frac{3}{8}$ inch thick, and is centered over underpan 20. The opposite sides of cover plate 22 are fitted into recesses 26 (about $\frac{3}{8}$ inch deep and $2\frac{1}{8}$ inch wide) in the tops of the wooden floor boards 16 on opposite sides of underpan 20 so that the top of the cover plate 22 is essentially flush with the tops of the floor boards 16. The duct 19, thus, has a cross-sectional area (measured transversely of the duct) of about 0.04 square feet. As also will be evident, the unsupported width of plate 22 (i.e., the width of the portion over pan 20, is less than 6 inches. Closed cell sponge adhesive or silicone caulking (not shown) typically is provided in the gap between the recesses 26 and the facing portions of plate 22. Thermally insulating tape 28 is placed between the top of each cross beam 14 and the adjacent bottom of each aluminum underpan 20 overlying the beam. Polyurethane insulation, typically about 4 inches thick, is foamed in place between adjacent pairs of cross beams 14, with the top of the insulation abutting the bottoms of the underpans 22 of the heating systems 18.

In the illustrated preferred embodiment, each cover plate 22 is conventional diamond plate aluminum (i.e., the top 25 defines a regular array of generally diamond-shaped projections 27), and the bottoms 23 of the cover plates are painted black. The cover plates 22 are held in place by conventional screws or bolts (not shown) which extend through the plates and wooden floor boards 16 into the flanges of the transverse I-beams 14.

The two longitudinally-extending heating elements 100 of each heating system 18 are secured (typically by an adhesive such as that sold by Morgan Adhesives under the trade name "Mactac") to the underside 23 of plates 22. The length of each heating element 100 is slightly less than one-half that of plate 22, and the two heating elements 200 are aligned end-to-end, with an about 18 inch space between their adjacent ends. There is a shorter space (e.g., about 3–6 inches) between the far end of each heating element 100 and the adjacent end of the duct.

The arrangement and connection of the heating elements is shown, somewhat schematically, in FIG. 3. As there illustrated a generator 200 (which typically is gas or diesel driven and is mounted on the underside of the trailer 8) is connected by a power cable 202 to a circuitry box 204 mounted below trailer bed 10. Four junction boxes 206 are also connected below trailer bed 10, midway the trailer's length, with one junction box below and associated with one of heating systems 10. Power cables extend through flexible conduits from circuitry box 204 to each junction box 206, and then from the respective junction box up through the bottom 19 of a trough 20 and to the two heating elements 100 in the trough.

For controlling the power provided to the heating systems, thermostats sense the temperature of the heating elements and that of the air in trailer 8.

Referring to FIG. 3, thermostats 220 are mounted in two of ducts 19 (as shown, in the position shown in the duct of inner one of each of the two pairs of heating systems), close to but slightly below the adjacent heating element 100, to sense the temperature of the air in the respective duct. Thermostats 220 monitor the temperature of the air closely adjacent the heating elements 100, and cause the circuitry box 206 to cut off power to all the heating elements in all of the heating systems if the temperature in any one of the ducts is sensed to have exceeded a preset limit, e.g., if the heating elements are heating to an unsafe or otherwise undesirable degree.

Two more thermostats 222 are mounted in and near the front of trailer 8, and sense air temperature inside the trailer. Circuity box 204 is arranged to apply 240 volts to heating systems 10 (and thus heat the trailer) when the temperature of the air in trailer 8 (as sensed by one of thermostats 222) is below the preset (and adjustable) desired temperature of the trailer interior; and to reduce the applied voltage to 120 volts (and thus essentially maintain the trailer temperature) when the preset desired temperature has been achieved.

The other of thermostats 222 acts as an over-temperature limiting device. It also is adjustable, and is preset to a desired upper-limit temperature (typically about 70° F.) and causes the circuitry box to cut off power entirely if the sensed air temperature in the trailer should exceed a preset upper limit.

Figure 4:
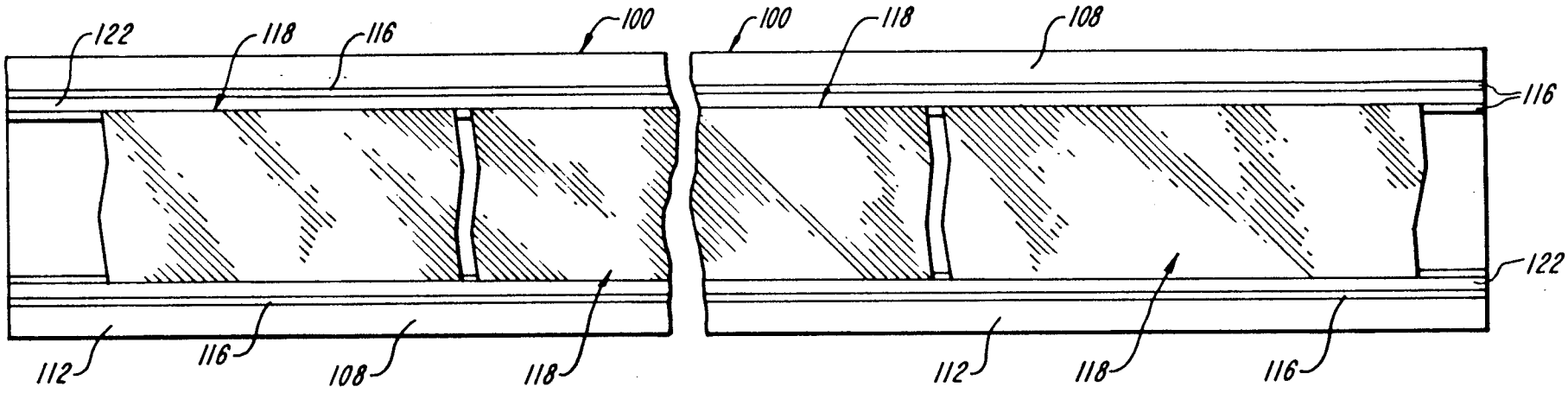
FIG. 4 is a plan view of a heating element used in the heating system of the present invention, with the top plastic layer removed for clarity.
Figure 5:
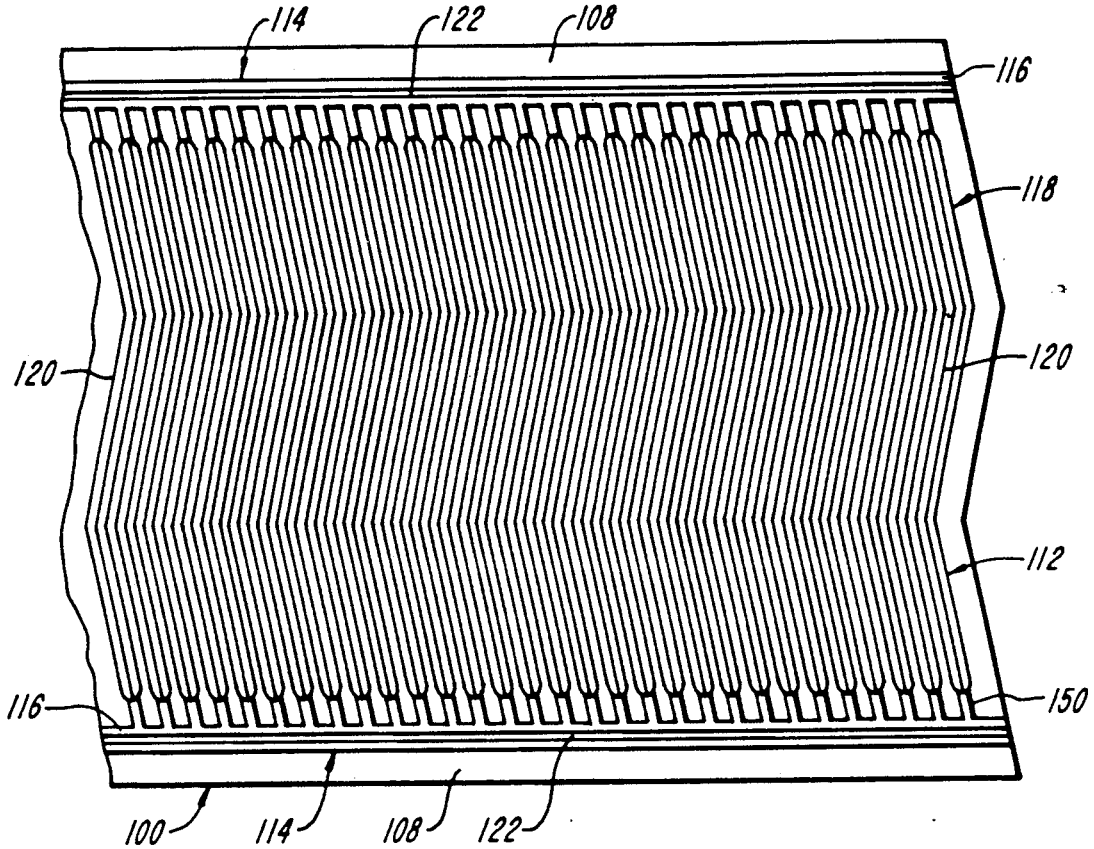
FIG. 5 is an enlarged view of a portion of the heating element of FIG. 4.
Figure 6:
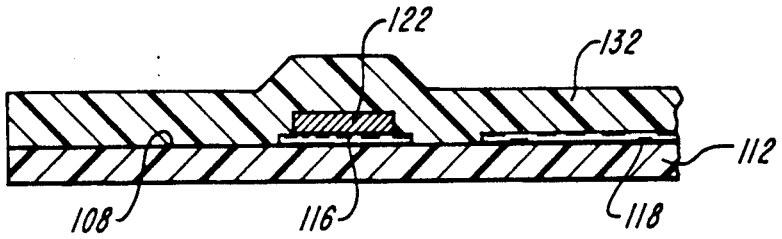
FIG. 6 is a section taken at 6—6 of FIG. 5.

In the preferred embodiment, and referring more particularly to FIGS. 4–6, each heating element 100 is of the type generally described in above-mentioned U. S. Patents. As there discussed, and shown in FIGS. 4–6, each heating element 100 comprises a pair of superposed plastic sheets 112, 132, and a semiconductor pattern 114 of colloidal carbon. In the preferred embodiment, the semiconductor pattern is screen printed on sheet 112. In other embodiments, the pattern 114 may be printed on a paper sheet which itself is sandwiched between plastic sheets 112, 132.

In the preferred embodiment, uncoated side boundary areas 108, each comprising a strip about 1¼ inches wide, extend from the outer side edges of pattern 114 to the side (longitudinal) edges of substrate 112. Substrate 112 is 0.004 inch thick polyester and is essentially transparent. The semiconductor pattern 114 is printed on the substrate at the thickness such that, when 240 volts are applied across the semiconductor pattern, the heating elements will provide a power density of about 80 watts per square foot.

Semiconductor pattern 114 includes a pair of parallel longitudinal conductor contact portions or "stripes" 116, each 0.231 (about 15/64) inch wide and the inside edges of which are spaced 5 inches apart, and a number of longitudinally spaced central heating portions 118. Each heating portion is about 12 in. long and 5 in. wide and comprises a plurality of bars 120 extending transversely between and electrically connected to stripes 114. In the preferred embodiment, each bar includes a pair of feeder segments 150 attached to the opposite ends of a trifurcated center portion which includes three relatively thin, longitudinally-spaced apart, transversely extending segments or barlets. The entire bar 120 extends across the heater along a zigzag path. In other embodiments, the bars may have a somewhat different configuration (as shown, for example, in U.S. Pat. No. 4,485,297) or may be printed over substantially the entire area between stripes 116 (as in U.S. Pat. No. 4,749,844).

A pair of electrodes 122, each comprising a tinned copper strip, extend longitudinally of the heater, one electrode extending along and engaging each of strips 116. Each electrode may be either a solid strip (as shown), or may include one or two transversely-spaced, longitudinally-extending rows of spaced square holes (see, for example, U.S. Pat. No. 4,749,844). It will be noted that each electrode extends substantially the entire length of the heater element 100, and thus is connected to all of the spaced heating portions 118 of that heater element.

Plastic cover sheet 132 [shown in FIG. 6 and comprising an essentially transparent co-lamination of an 0.005 cm. (0.002 in.) thick polyester ("Mylar") and an 0.007 cm. (0.003 inc.) thick adhesive binder, e.g., polyethylene] overlies plastic substrate sheet 112, semiconductor pattern 114 and conductors 122. The conductors 122 are not themselves bonded to the underlying substrate sheet 112 or semiconductor material, and the cover sheet 132 bonds poorly to the semiconductor pattern. However, the polyethylene forming the bottom layer of cover sheet 132 bonds well to substrate sheet 112. In particular, the cover sheet and substrate sheet are laminated together (as taught in U.S. Pat. No. 4,485,297) and the polyethylene bottom layer of cover sheet 132 bonds the cover sheet tightly to the longitudinally-extending, uncoated (with semiconductor material) areas 108 of substrate 112 between the outside edge of each conductor 122 and the adjacent outside edge of the heater element, and also to semiconductor free areas along the inside edge of each conductor 122. Sheet 132 thus holds the conductors 122 tightly in place against the underlying semiconductor stripes 116. Further, because the substrate 112 and cover sheet 132 are sealed tightly to each other in the areas 108 between the outside edge of conductors 122 and the outer edges of the heater, the unit is essentially hermetically sealed.

As already noted, the semiconductor pattern 114 of heating element 100 is about 5 inches wide (measured transversely of the heating element, from the inside edge of one stripe 116 to the inside of the other stripe 116) and the overall width of the heating element 110 is about 7 inches. The heating element is mounted on the bottom 23 of cover plate 22, centered over and facing towards the bottom of underpan 20. Thus, the heating portion of the heating element is wholly within duct 19, while the semiconductor free edge portions 18 of sheets 114, 116 extend into recesses 26.

Other Embodiments

In the previously discussed embodiment, the duct 19 formed by pan 20 and plate 22 has a cross-sectional area of about 0.04 square feet (about 5.75 square inches). In other embodiments, the cross-section of the duct may vary, e.g., between about 0.001 square feet (about 1.5 square inches) and about 0.11 square feet (about 16 square inches), but typically the minimum dimension (usually height) of the duct will not be less than about ½ inch or more than about 2 inches, and the maximum dimension (usually width) will be between about 3 and about 8 inches.

The overall width and thickness of the cover plate also may vary, e.g., between about ¼ in. and ½ in. in thickness and about 5 to 12 inches in width. Whatever width and thickness are used, the cover plate typically will extend beyond (e.g., ½ in. to 2 in.) the vertical sides of the underpan; and the cover plate typically will be made of a material having a thermal conductivity not less than about 50 watts per square meter per degree Celsius, and preferably not less than about 100 watts per square meter per degree Celsius.

Similarly, the number of heating elements in each system may vary. In the illustrated embodiment, there are two heating elements (each about 21 feet long) in a heating system having an overall length of about 43–44 feet. Shorter heating systems may use fewer heating elements per system, or each heating element itself may be shorter.

These and other embodiments will be within the scope of the following claims.

What is claimed is:

1. A heating system for an area having a generally horizontal support surface, said area comprising:

a longitudinally-extending duct below said support surface, a generally flat plate of heat conducting material forming the top of said duct and being mounted so that the top surface of said plate forms a portion of and is generally coplanar with other portions of said support surface; and, an electric sheet heater mounted within said duct in face-to-face engagement with the underside of said plate and extending a major portion of the width of said duct, said duct and said heater being arranged to provide a heat flow passage within said duct below said heater.

2. The heating system of claim 1 wherein said heater is mounted at the top of said duct closely adjacent the underside of said plate.

3. The heating system of claim 1 wherein said heater is a sheet heater and is secured to the underside of said plate.

4. The heating system of claim 1 wherein said duct comprises a generally channel-shaped metal trough.

5. The heating system of claim 4 wherein said duct is generally rectangular in transverse cross-system, and wherein the bottom area of said trough reflects heat radiation.

6. A heating system for an area having a generally horizontal support surface, said area comprising:

a longitudinally-extending duct below said support surface, a generally flat plate of heat conducting material forming the top of said duct and being mounted so that the top surface of said plate forms a portion of and is generally coplanar with other portions of said support surface;

an electric heater mounted within said duct; and longitudinally-extending members of relatively heat-insulating material positioned along and engaging the opposite longitudinally-extending sides of said duct.

7. A heating system for a storage area having a floor comprising a plurality of longitudinally-extending floor members positioned such that the top surfaces of said members are generally coplanar, said system comprising:

a longitudinally-extending metal duct of generally rectangular transverse cross-section positioned between a pair of said floor members such that the bottom of said duct defines a generally horizontal surface spaced below the plane of the top surface of said floor members;

a longitudinally-extending metal plate forming the top of said duct, the top of said plate being generally coplanar with the top surfaces of said floor members; and a longitudinally-extending electric heater mounted within said duct in contact with the underside of said plate, said duct defining a longitudinally-extending heat flow passage below said heater having a transverse cross-sectional area of not less than 0.001 sq. ft.

8. The heating system of claim 7 wherein the interior surface of the bottom of said duct is polished metal.

9. The heating system of claim 7 wherein said heater is a sheet heater.

10. The heating system of claim 9 wherein said sheet heater comprises a pair of superimposed sheets of organic plastic and, therebetween, a pair of longitudinally-extending electrodes and a layer of semiconductor material extending between and electrically connected to said electrodes.

11. The heating system of claim 7 wherein said heater is a sheet heater and is attached to the interior surface of said plate.

12. The heating system of claim 7 wherein the inside surface of said plate is coated with a radiant heat absorbing material.

13. The heating system of claim 7 wherein said duct has a cross-section transverse thereof in the range of about 0.01 square feet to about 0.25 square feet.

14. The heating system of claim 13 wherein said size is about 0.01 square feet to about 0.10 square feet.

15. The heating system of claim 7 wherein the width of said duct is in the range of 3 to 8 inches.

16. The heating system of claim 15 wherein the height of said duct is in the range of 0.5 to 2 inches.

17. The heating system of claim 7 wherein said plate has a cross-sectional area, measured transversely thereof, in the range of about 1 to about 6 square inches.

18. A heating system for a storage area having a floor comprising a plurality of longitudinally-extending floor members positioned such that the top surfaces of said members are generally coplanar on said system comprising:

a longitudinally-extending metal duct of generally rectangular transverse cross-section positioned between a pair of said floor members such that the bottom of said duct defines a generally horizontal surface spaced below the plane of the top surfaces of said floor members;

a longitudinally-extending metal plate forming top of said duct, the top of said plate being generally coplanar with the top surfaces of said floor members; and a longitudinally-extending electric heater mounted within said duct closely adjacent the underside of said plate, said duct defining a longitudinally-extending heat flow passage having a transverse cross-sectional area of not less than 0.001 sq. ft., and said plate having a width at least two inches greater than the width of said duct and being centered substantially longitudinally of said duct, the portions of said plate that extend beyond the opposite sides of said duct being supported by said floor members.

19. The heating system of claim 18 wherein said floor members define recesses in the upper surfaces thereof adjacent the opposite sides of said ducts, said portions of said plate being positioned in said recesses.

20. A heating system for a storage area having a floor comprising a plurality of longitudinally-extending floor members positioned such that the top surfaces of said members are generally coplanar on said system comprising:

a longitudinally-extending metal duct of generally rectangular transverse cross-section positioned between a pair of said floor members such that the bottom of said duct defines a generally horizontal surface spaced below the plane of the top surfaces of said floor members;

a longitudinally-extending metal plate forming top of said duct, the top of said plate being generally coplanar with the top surfaces of said floor members; and a longitudinally-extending electric heater mounted within said duct closely adjacent the underside of said plate, said duct defining a longitudinally-extending heat flow passage having a transverse cross-sectional area of not less than 0.001 sq. ft., and comprising a generally channel-shaped in transverse cross-section member having a pair of flanges extending outwardly from the opposite top edges thereof, said flanges being positioned in recesses in said floor members adjacent the opposite sides of said ducts and underlying portions of said plate.

21. The heating system of claim 20 wherein said heater is a sheet heater comprising a layer of conductive graphite material between a pair of organic plastic sheets, one of said sheets being adhesively attached to the underside of said plate within said duct.

22. The heating system of claim 7 wherein said plate is of a material having a thermal conductivity not less than about 100 watts per square meter per degree Celsius.

* * * * *